US012066029B2

(12) United States Patent
Fukami

(10) Patent No.: US 12,066,029 B2
(45) Date of Patent: Aug. 20, 2024

(54) VACUUM PUMP AND CONTROLLER

(71) Applicant: Edwards Japan Limited, Yachiyo (JP)

(72) Inventor: Hideo Fukami, Yachiyo (JP)

(73) Assignee: Edwards Japan Limited, Yachiyo (JP)

( * ) Notice: Subject to any disclaimer, the term of this patent is extended or adjusted under 35 U.S.C. 154(b) by 0 days.

(21) Appl. No.: 17/796,689

(22) PCT Filed: Feb. 10, 2021

(86) PCT No.: PCT/JP2021/005103

§ 371 (c)(1),
(2) Date: Aug. 1, 2022

(87) PCT Pub. No.: WO2021/166777

PCT Pub. Date: Aug. 26, 2021

(65) Prior Publication Data

US 2023/0057241 A1 Feb. 23, 2023

(30) Foreign Application Priority Data

Feb. 19, 2020 (JP) ..... 2020-025805

(51) Int. Cl.
*F04D 27/00* (2006.01)
*F04D 19/04* (2006.01)
*F04D 29/58* (2006.01)

(52) U.S. Cl.
CPC ..... *F04D 27/006* (2013.01); *F04D 19/04* (2013.01); *F04D 29/584* (2013.01)

(58) Field of Classification Search
CPC ..... F04D 19/04; F04D 27/006; F04D 29/584
See application file for complete search history.

(56) References Cited

U.S. PATENT DOCUMENTS 6,793,466 B2 * 9/2004 Miyamoto ..... F04D 29/584 417/313
7,965,054 B2 * 6/2011 Tsunazawa ..... H02K 11/25 374/129

(Continued)

FOREIGN PATENT DOCUMENTS

JP H11210673 A 8/1999
JP 2005273657 A 10/2005

(Continued)

OTHER PUBLICATIONS

International Search Report and Written Opinion of International Application No. PCT/JP2021/005103 dated May 11, 2021, 9 pp.

*Primary Examiner* — Topaz L. Elliott
*Assistant Examiner* — Jason G Davis
(74) *Attorney, Agent, or Firm* — Shumaker & Sieffert, P.A.

(57) ABSTRACT

A vacuum pump that allows for timely inspection and replacement of a temperature adjustment means, prevents unexpected stopping, and limits the maintenance cost, and a controller that controls the vacuum pump are proposed. The present disclosure relates to a vacuum pump for exhausting gas from an apparatus, such as manufacturing equipment, subjected to exhaustion. The vacuum pump includes: a temperature adjustment means for causing a predetermined area of the vacuum pump to have a predetermined temperature; an output control means configured to operate the temperature adjustment means; and an information output means configured to output information regarding ON/OFF of the temperature adjustment means obtained from the output control means.

1 Claim, 8 Drawing Sheets

(56) References Cited

U.S. PATENT DOCUMENTS

| | | | | |
|---|---|---|---|---|
| 10,474,143 | B2 * | 11/2019 | Kozaki | G01L 1/18 |
| 11,359,634 | B2 * | 6/2022 | Fukami | F04D 19/04 |
| 2015/0226229 | A1 | 8/2015 | Tsutsui | |

FOREIGN PATENT DOCUMENTS

| | | | | |
|---|---|---|---|---|
| JP | 2020012423 | A | 1/2020 | |
| WO | 2014045438 | A1 | 3/2014 | |
| WO | WO-2019239934 | A1 * | 12/2019 | F04D 19/04 |

* cited by examiner

| OUTPUT DEVICE | DURATION | | CYCLE TIME INTERVAL |
|---|---|---|---|
| OD1 | ON | 1 MIN 45 SEC ±20 SEC | 3 MIN 40 SEC ± 40 SEC |
| | OFF | 1 MIN 55 SEC ±20 SEC | |
| OD2 | ON | 40 SEC ±10 SEC | 8 MIN 00 SEC ± 20 SEC |
| | OFF | 7 MIN 20 SEC ±10 SEC | |

Fig. 6

VACUUM PUMP AND CONTROLLER

This application is a U.S. national phase application under 35 U.S.C. § 371 of international application number PCT/JP2021/005103 filed on Feb. 10, 2021, which claims the benefit of JP application number 2020-025805 filed on Feb. 19, 2020. The entire contents of each of international application number PCT/JP2021/005103 and JP application number 2020-025805 are incorporated herein by reference.

TECHNICAL FIELD

The present disclosure relates to a vacuum pump and a controller.

BACKGROUND

Vacuum pumps are typically used for the exhaustion of vacuum chambers in semiconductor manufacturing apparatuses such as CVD apparatuses. In particular, turbomolecular pumps are often used for reasons such as less residual gas and easy maintenance.

The manufacturing process of semiconductors includes steps that apply various process gases to semiconductor substrates. A turbomolecular pump may be used to exhaust such process gases from the chamber of a semiconductor manufacturing apparatus, as well as to produce a vacuum in the chamber.

A process gas may be introduced at a high temperature into the chamber to increase the reactivity. In this case, as the process gas is exhausted, its temperature decreases while its pressure increases. Thus, the gas desublimates into a solid, causing products to be deposited. That is, such a process gas may desublimate in the turbomolecular pump, causing solidified products to adhere and gradually accumulate inside the turbomolecular pump. This may narrow the pump flow passage and lower the performance of the turbomolecular pump.

To solve this problem, a configuration has been used that heats an area where deposits tend to accumulate to a predetermined temperature by incorporating a heater, for example, into the turbomolecular pump. The energization state of the heater is switched using a relay. As shown in FIG. 8 (a system configuration diagram of a conventional vacuum pump (turbomolecular pump)), the configuration uses a TMS temperature measurement portion, which is connected to a TMS temperature sensor, to measure the temperature of the turbomolecular pump, compares the measured value with the preset temperature, and controls the output to the heater or the like. When heat is diffused from the heater or the like and increases the temperature of the turbomolecular pump, the electronic circuit incorporated therein is affected. The increased temperature may also lower the magnetic force of the permanent magnets used in the motor of the rotating body of the pump, and may break the electromagnet windings. For this reason, a water-cooled tube is arranged around these areas, and the flow of cooling water is controlled using a valve or the like (see Japanese Patent Application Publication No. 2003-148379, for example). As described above, some conventional vacuum pumps have built-in temperature adjustment means (such as a heater, a relay, a water-cooled tube, a valve) for causing predetermined areas of the vacuum pumps to have predetermined temperatures.

SUMMARY

The conventional vacuum pump described above may have a protection function processing portion shown in FIG. 8 that compares the measured value measured by the TMS temperature measurement portion with the allowable temperature and provides notification of any high temperature overheating abnormality/warning, temperature rise abnormality, low temperature abnormality, breaking/short circuit abnormality, and the like. However, the lifespans of the relay and the valve (the number of ONs/OFFS and ON/OFF time) are not taken into consideration, and the vacuum pump may be continuously used until they malfunction. When the relay or the valve fails, the vacuum pump may become abnormally hot or cold. This may cause some malfunction that suddenly stops the vacuum pump.

Such stopping of the vacuum pump during operation may affect the quality of the semiconductors being manufactured, for example. To prevent the unexpected stopping of the vacuum pump, some vacuum pumps are managed so that their relays and valves are periodically replaced regardless of the frequency of operation. However, such management results in the replacement of a relay or valve that has not actually reached its end of life. This increases the maintenance cost.

In view of the foregoing, it is an objective of the present disclosure to provide a vacuum pump that allows for a timely inspection or replacement of a temperature adjustment means for causing a predetermined area of the vacuum pump to have a predetermined temperature, thus prevents unexpected stopping, and limits the maintenance cost, and a controller that controls the vacuum pump.

The present disclosure relates to a vacuum pump for exhausting gas from an apparatus subjected to exhaustion. The vacuum pump includes: a temperature adjustment means for causing a predetermined area of the vacuum pump to have a predetermined temperature; an output control means configured to operate the temperature adjustment means; and an information output means configured to output information regarding ON/OFF of the temperature adjustment means obtained from the output control means.

In this vacuum pump, the information output means is preferably configured to output information regarding the number of ONs or the number of OFFs of the temperature adjustment means as the information regarding ON/OFF of the temperature adjustment means.

The information output means may be configured to output information regarding ON time or OFF time of the temperature adjustment means as the information regarding ON/OFF of the temperature adjustment means.

The present disclosure also relates to a controller for controlling a vacuum pump main body that exhausts gas from an apparatus subjected to exhaustion. The vacuum pump main body includes a temperature adjustment means for causing a predetermined area of the vacuum pump main body to have a predetermined temperature. The controller includes: an output control portion configured to operate the temperature adjustment means; and an information output portion configured to output information regarding ON/OFF of the temperature adjustment means obtained from the output control portion.

According to the vacuum pump and the controller of the present disclosure, a temperature adjustment means can be timely inspected and replaced based on the information regarding ON/OFF of the temperature adjustment means output from an information output means. This prevents unexpected stopping of the vacuum pump and also limits the maintenance cost.

BRIEF DESCRIPTION OF THE DRAWINGS

FIG. 6 is a table showing the ON durations, the OFF durations, and the cycle time intervals (all after averaging processing) of OD1 and OD2 shown in FIG. 5.

DETAILED DESCRIPTION

Figure 1:
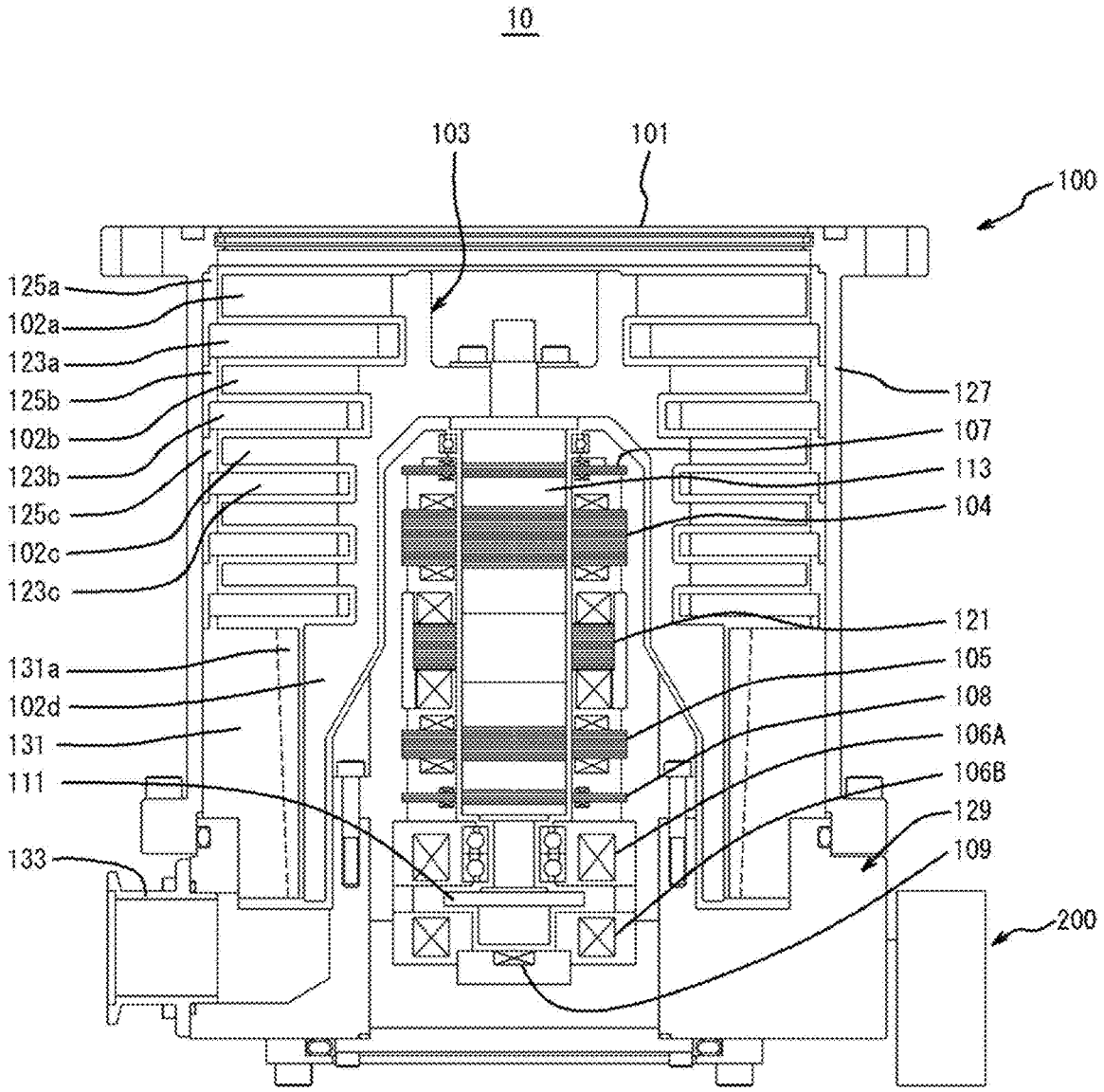
FIG. 1 is a cross-sectional view schematically showing a vacuum pump main body according to an example of the present disclosure.
Figure 2:
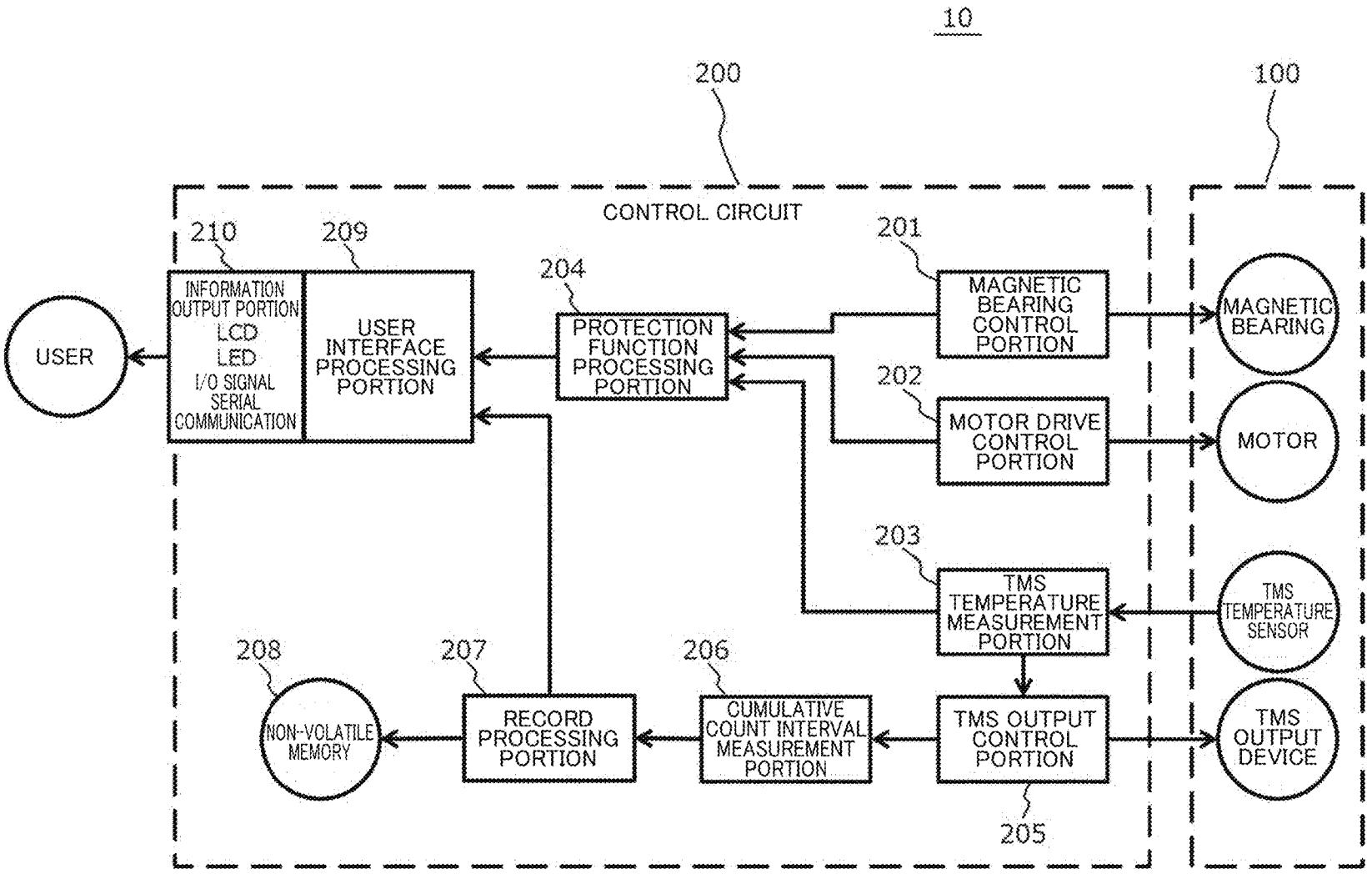
FIG. 2 is a system configuration diagram of a vacuum pump according to an example of the present disclosure.

Referring to drawings, an example of a vacuum pump and a controller according to the present disclosure is now described. The vacuum pump of the present example is a turbomolecular pump 10 and includes a pump main body 100 and a controller 200 as shown in FIGS. 1 and 2. The pump main body 100 of the turbomolecular pump 10 of the present example is connected to an apparatus subjected to exhaustion (not shown), which may be a semiconductor manufacturing apparatus or the like. Under the control of the controller 200, the turbomolecular pump 10 exhausts a process gas from a chamber of the apparatus subjected to exhaustion.

First, the pump main body 100 is described. The pump main body 100 includes a circular outer cylinder 127 having an inlet port 101 at its upper end. A rotating body 103 located in the outer cylinder 127 includes a plurality of rotor blades 102*a*, 102*b*, 102*c*, . . . , which are turbine blades for process gas suction and exhaustion, in its outer circumference section. The rotor blades 102*a*, 102*b*, 102*c*, . . . extend radially in multiple stages.

The rotating body 103 has a rotor shaft 113 in its center. The rotor shaft 113 is suspended in the air and position-controlled by a 5-axis magnetic bearing, for example.

Upper radial electromagnets 104 of the present example include four electromagnets. These electromagnets are arranged in pairs along an X-axis and a Y-axis, which are radial axes of the rotor shaft 113 that are perpendicular to each other. The pump main body 100 also includes upper radial sensors 107, which include four electromagnets positioned adjacent to the upper radial electromagnets 104. The upper radial sensors 107 detect a radial displacement of the rotating body 103 and send the information to the controller 200.

Based on the signal of the displacement detected by the upper radial sensors 107, the controller 200 controls the excitation of the upper radial electromagnets 104 via a compensation circuit having a PID adjustment function to adjust the radial position of the upper part of the rotor shaft 113.

The rotor shaft 113 may be made of a high magnetic permeability material (such as iron) and is configured to be attracted by magnetic forces of the upper radial electromagnets 104. The magnetic forces are adjusted independently in the X-axis direction and the Y-axis direction.

Lower radial electromagnets 105 and lower radial sensors 108 are arranged in a similar manner as the upper radial electromagnets 104 and the upper radial sensors 107 to adjust the radial position of the lower part of the rotor shaft 113 in a similar manner as the radial position of the upper part.

Axial electromagnets 106A and 106B are arranged so as to vertically sandwich a circular metal disc 111, which is provided in the lower part of the rotor shaft 113. The metal disc 111 is made of a high magnetic permeability material such as iron. An axial sensor 109 is provided to detect an axial displacement of the rotor shaft 113 and send an axial displacement signal to the controller 200.

Based on the axial displacement signal, the excitation of the axial electromagnets 106A and 106B is controlled through the compensation circuit of the controller 200 having the PID adjustment function. The axial electromagnets 106A and 106B attract the metal disc 111 upward and downward, respectively, by magnetic force.

As described above, the controller 200 appropriately adjusts the magnetic forces exerted by the axial electromagnets 106A and 106B on the metal disc 111, magnetically levitates the rotor shaft 113 in the axial direction, and suspends the rotor shaft 113 in the air in a non-contact manner.

A motor 121 includes a plurality of magnetic poles circumferentially arranged to surround the rotor shaft 113. Each magnetic pole is controlled by the controller 200 so as to drive and rotate the rotor shaft 113 via an electromagnetic force acting between the magnetic pole and the rotor shaft 113.

A plurality of stator blades 123*a*, 123*b*, 123*c*, . . . are arranged slightly spaced apart from the rotor blades 102*a*, 102*b*, 102*c*, . . . . Each rotor blade 102*a*, 102*b*, 102*c*, . . . is inclined by a predetermined angle from a plane perpendicular to the axis of the rotor shaft 113 in order to transfer the molecules of the exhaust process gas downward through collision.

The stator blades 123*a*, 123*b*, 123*c*, . . . are also inclined by a predetermined angle from a plane perpendicular to the axis of the rotor shaft 113, extend inward of the outer cylinder 127, and alternate with the stages of the rotor blades 102*a*, 102*b*, 102*c*, . . . . One end of each of the stator blades 123*a*, 123*b*, 123*c*, . . . is inserted between and thus supported by a plurality of layered stator blade spacers 125*a*, 125*b*, 125*c*, . . . .

The stator blade spacers 125*a*, 125*b*, 125*c*, . . . are ring-shaped members made of a metal, such as aluminum, iron, stainless steel, or copper, or an alloy containing these metals as components, for example.

The outer cylinder 127 is fixed to the outer circumference of the stator blade spacers 125*a*, 125*b*, 125*c*, . . . with a slight gap. A base portion 129 is provided at the base of the outer cylinder 127. A threaded spacer 131 is provided between the lower part of the stator blade spacers 125*a*, 125*b*, 125*c*, . . . and the base portion 129. A section of the base portion 129 below the threaded spacer 131 has an outlet port 133 communicating with the outside.

The threaded spacer 131 is a cylindrical member made of a metal such as aluminum, copper, stainless steel, or iron, or an alloy containing these metals as components. The threaded spacer 131 has a plurality of helical thread grooves 131*a* in its inner circumference surface. When molecules of exhaust process gas move in the rotation direction of the rotating body 103, these molecules are transferred toward the outlet port 133 in the direction of the helix of the thread grooves 131*a*.

In the lowermost part of the rotating body 103 below the rotor blades 102*a*, 102*b*, 102*c*, . . . , a rotor blade 102*d* extends downward. The outer circumference surface of the rotor blade 102*d* is cylindrical and projects toward the inner circumference surface of the threaded spacer 131. The outer circumference surface is adjacent to but separated from the inner circumference surface of the threaded spacer 131 by a predetermined gap.

The base portion 129 is a disc-shaped member forming the base section of the turbomolecular pump 10, and is typically made of a metal such as iron, aluminum, or stainless steel.

The base portion 129 physically holds the turbomolecular pump 10 and also serves as a heat conduction path. As such, the base portion 129 is preferably made of rigid metal with high thermal conductivity, such as iron, aluminum, or copper.

In the pump main body 100 thus configured, when the motor 121 drives and rotates the rotor blades 102*a*, 102*b*, 102*c*, . . . together with the rotor shaft 113, the actions of the rotor blades 102*a*, 102*b*, 102*c*, . . . and the stator blades 123*a*, 123*b*, 123*c*, . . . cause the suction of process gas from the apparatus subjected to exhaustion through the inlet port 101.

The process gas sucked through the inlet port 101 moves between the rotor blades 102*a*, 102*b*, 102*c*, . . . and the stator blades 123*a*, 123*b*, 123*c*, . . . and is transferred to the base portion 129. At this time, factors such as the frictional heat generated when the process gas comes into contact or collides with the rotor blades 102*a*, 102*b*, 102*c*, . . . and the conduction or radiation of heat generated by the motor 121 increase the temperature of the rotor blades 102*a*, 102*b*, 102*c*, . . . . This heat is conducted to the stator blades 123*a*, 123*b*, 123*c*, . . . through radiation or conduction via gaseous molecules of the process gas, for example.

The stator blade spacers 125*a*, 125*b*, 125*c*, . . . are joined to one another at the outer circumference section and transfer the heat received by the stator blades 123*a*, 123*b*, 123*c*, . . . from the rotor blades 102*a*, 102*b*, 102*c*, . . . and the frictional heat generated when the process gas comes into contact or collides with the stator blades 123*a*, 123*b*, 123*c*, . . . to the outer cylinder 127 and the threaded spacer 131, for example. The process gas transferred to the threaded spacer 131 is guided by the thread grooves 131*a* to the outlet port 133 and is then exhausted from the pump main body 100.

As described above, a decrease in the temperature or an increase in the pressure may cause the process gas to desublimate into a solid, resulting in deposited products. In the pump main body 100, the temperature around the outlet port 133 may be low. In particular, since the gaps are narrow near the rotor blade 102*d* and the threaded spacer 131, the deposited products of process gas tend to narrow the flow passage in this area. For this reason, the pump main body 100 of the present example includes a heater, an annular water-cooled tube, and a temperature sensor (for example, a thermistor) provided at the outer circumference of the base portion 129, for example. The signal of this temperature sensor is used to perform control of the heating by the heater and the cooling by the water-cooled tube (hereinafter referred to as temperature management system (TMS) control) so as to maintain the temperature of the base portion 129 at a temperature that does not cause products to be deposited (preset temperature). The higher the preset temperature of the TMS control, the less likely for products to accumulate. As such, it is desirable to increase the preset temperature as high as possible.

On the other hand, a higher temperature of the base portion 129 increases the temperature of the electronic circuit attached to the base portion. When the temperature becomes higher than expected due to fluctuations in the exhaust load, for example, and exceeds the allowable temperature of the semiconductor memory provided in the electronic circuit, the control parameters and maintenance information data, such as pump actuation time and error history, recorded in the memory may be erased. Such loss of maintenance information data would hinder the determination on the timing of maintenance and inspection, for example, thus posing a serious problem.

Also, when the temperature of the base portion 129 becomes higher than expected, the temperature of the winding of the electromagnet forming a magnetic pole of the motor 121 may also exceed its allowable temperature due to an increase in the current flowing in the winding. In this case, the electromagnet winding may break and stop the motor.

As such, in the pump main body 100, a heater and a water-cooled tube are arranged at appropriate positions in an area in which the temperature should be high (for example, near the rotor blade 102*d* and the threaded spacer 131) and an area in which the temperature should be limited (for example, near an electronic circuit and the motor 121). The controller 200 timely switches ON/OFF of the relay for switching the energization state of the heater, the valve connected to the water-cooled tube, and the like to maintain the predetermined areas of the pump main body 100 at predetermined temperatures. In the present example, "temperature adjustment means" as used herein refers to the heater, relay, water-cooled tube, valve, and the like described above.

Referring to FIG. 2, the controller 200 is now described in detail. The controller 200 includes various electronic components and a substrate on which they are mounted, for example, and is configured to perform the functions described below.

A magnetic bearing control portion 201 controls the magnetic bearing in the pump main body 100 (controls the axial electromagnets 106A and 106B in FIG. 1), and a motor drive control portion 202 controls the motor (the motor 121 in FIG. 1). A TMS temperature measurement portion 203 measures the temperature of a predetermined area of the pump main body 100 based on the output signal from a temperature sensor for performing TMS control (hereinafter referred to as a "TMS temperature sensor").

The magnetic bearing control portion 201, the motor drive control portion 202, and the TMS temperature measurement portion 203 described above are connected to a protection function processing portion 204. The protection function processing portion 204 monitors whether the pump main body 100 has an abnormality based on the information on the magnetic bearing obtained from the magnetic bearing control portion 201, the information on the motor obtained from the motor drive control portion 202, and the temperature information of the predetermined area obtained from the TMS temperature measurement portion 203. In case of an abnormality condition, the protection function processing portion 204 performs a process of protecting the pump main body 100 (for example, automatically stops the pump main body 100). When the pump main body 100 has an abnormality, the protection function processing portion 204 also functions to convert the information into data that can be processed by a user interface processing portion 209, which will be described below, and output the data to the user interface processing portion 209.

Based on the temperature information of the predetermined area obtained from the TMS temperature measurement portion 203, a TMS output control portion 205 sends a command to an output device for performing TMS control (hereinafter referred to as a "TMS output device") to control ON/OFF of the TMS output device. In this example, the TMS output device corresponds to the relay for switching the energization state of the heater and the valve connected to the water-cooled tube. The TMS output control portion 205 corresponds to the "output control means" and "output control portion" as used herein.

A cumulative count interval measurement portion 206 may count the number of ONs and the number of OFFs of the TMS output device and the ON time and the OFF time of the TMS output device, for example, based on the information regarding ON/OFF of the TMS output device (information that the TMS output device is turned ON or OFF) obtained from the TMS output control portion 205.

A record processing portion 207 converts measured values regarding ON/OFF of the TMS output device obtained from the cumulative count interval measurement portion 206 (for example, the cumulative number of ONs (number of OFFs) of the TMS output device, ON time (OFF time) of the TMS output device, and the average values thereof) into data that can be recorded in a non-volatile memory 208 and data that can be processed by the user interface processing portion 209, and output the data to these portions. The record processing portion 207 also functions to call up data recorded in the non-volatile memory 208 and output the data to the cumulative count interval measurement portion 206 and the user interface processing portion 209.

The non-volatile memory 208 periodically records the data obtained from the record processing portion 207. Specific examples of the non-volatile memory 208 include an EEPROM and a FeRAM. The present example uses the non-volatile memory 208, but other recording means such as a volatile memory (SRAM or DRAM) may also be used.

The user interface processing portion 209 is connected to an information output portion 210, which will be described below, and converts the data obtained from the record processing portion 207 and the protection function processing portion 204 into signals and the like that can be output by the information output portion 210.

Based on the signal or the like obtained from the user interface processing portion 209, the information output portion 210 outputs information regarding ON/OFF of the TMS output device and information regarding an abnormality of the pump main body 100. For example, the information output portion 210 may be a component that outputs information by displaying texts and images, such as an LCD, or a component that emits light (blinks), such as an LED. Also, the information output portion 210 is not limited to a component that allows the user to visually perceive the information, such as an LCD and an LED, and may be a component that allows for perception through another sense (for example, sound may be output and perceived by the user's sense of hearing). Furthermore, the information output portion 210 may be an external terminal capable of I/O signal communication or serial communication, for example, to provide information to the user via another device arranged separately from the turbomolecular pump 10.

The information output portion 210 corresponds to the "information output means" as used herein.

The controller 200 configured as described above allows the pump main body 100 to operate normally, notifies the user of any abnormality through the information output portion 210, and prompts the user to timely inspect or replace the temperature adjustment means.

Figure 3:
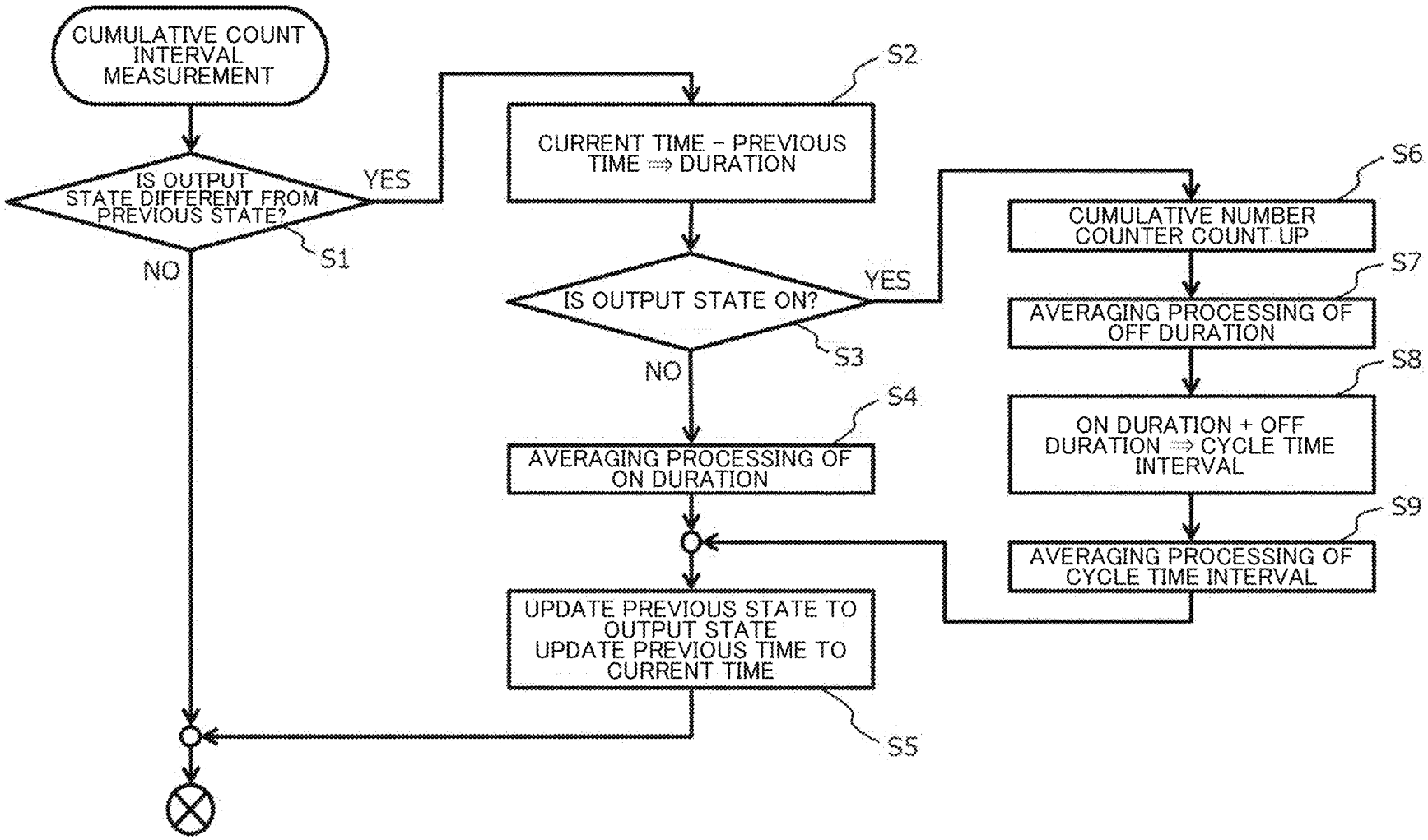
FIG. 3 is a flowchart showing an operation of a vacuum pump according to an example of the present disclosure.

Referring to FIG. 3, the "cumulative count interval measurement" performed for timely inspection and replacement of the temperature adjustment means is now described. The cumulative count interval measurement is mainly performed by the cumulative count interval measurement portion 206. At step 1, based on the information obtained from the TMS output control portion 205 indicating that the TMS output device is turned ON or OFF, the cumulative count interval measurement portion 206 determines whether the TMS output device is currently in the ON state or the OFF state and also determines whether the current state is the same or different from the state of the TMS output device determined at the previous step 1 (S1 in FIG. 3).

As a result of step 1, when the current state of the TMS output device is the same as the state determined at the previous step 1 (NO at S1 in FIG. 3), the current cumulative count interval measurement ends. The cumulative count interval measurement is repeated in a short cycle (e.g., 30 ms), and the next cumulative count interval measurement is immediately performed.

As a result of step 1, when the current state of the TMS output device is different from the state determined at the previous step 1 (YES at S1 in FIG. 3), the cumulative count interval measurement portion 206 proceeds to step 2 and subtracts the time at which the answer was YES at the previous step 1 from the current time to calculate the duration in which the TMS output device maintains the state (S2 in FIG. 3).

Figure 4:
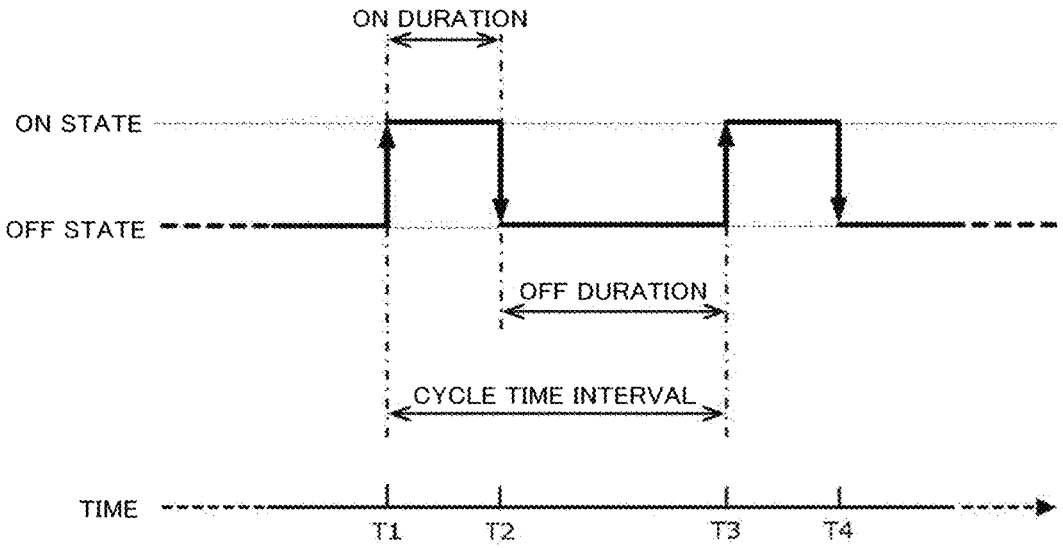
FIG. 4 is a diagram showing an ON duration, an OFF duration, and a cycle time interval.

This step is described specifically with reference to FIG. 4. For example, when the current time is T2 shown in FIG. 4, step 2 is performed since the TMS output device has changed from the ON state to the OFF state (YES at step 1). It is assumed that the time at which the answer was YES at the previous step 1 (T1 in this example) is recorded in the non-volatile memory 208. The cumulative count interval measurement portion 206 calls up time T1 at which the answer was YES at the previous step 1 from the non-volatile memory 208 via the record processing portion 207 and subtracts time T1 from time T2 to calculate the period between these times.

After performing step 2, the cumulative count interval measurement portion 206 performs step 3 for determining whether the TMS output device is currently in the ON state (S3 in FIG. 3).

For example, when the current time is time T2 shown in FIG. 4, since the TMS output device is in the OFF state, the answer at step 3, or S3 in FIG. 3, is NO. The process thus proceeds to step 4 (S4 in FIG. 3). The TMS output device is maintained in the ON state from time T1 to time T2. The cumulative count interval measurement portion 206 sets the period between these times (the period of T2-T1 calculated at step 2) as an "ON duration". At step 4, the cumulative count interval measurement portion 206 performs averaging processing on the calculated ON duration of T2-T1. The averaging processing averages the currently calculated ON duration of T2-T1 using past ON durations. There is no limitation to the averaging technique. In one example, the ON durations for the latest (n−1) determinations are added to the ON duration of T2-T1, and the sum of the ON durations is divided by n. The past ON durations are recorded in the non-volatile memory 208. In performing step 4, the cumulative count interval measurement portion 206 calls up durations from the non-volatile memory 208 via the record processing portion 207.

After performing step 4, the cumulative count interval measurement portion 206 performs step 5 for updating the previous information (the information obtained when the answer was YES at the previous step 1) recorded in the non-volatile memory 208 (S5 in FIG. 3). When the current time is T2 shown in FIG. 4 and the time at which the answer was YES at the previous step 1 is T1, the cumulative count interval measurement portion 206 updates, via the record processing portion 207, the previous information recorded in the non-volatile memory 208 from time T1 to time T2, and also updates the state of the TMS output device at time T1 (ON state) to the state of the TMS output device at time T2 (OFF state). The cumulative count interval measurement portion 206 also records, via the record processing portion 207, the ON durations of T2-T1 before and after averaging processing in the non-volatile memory 208. After step 5, the current cumulative count interval measurement ends.

When the current time at which the answer is YES at step 1 is T3 shown in FIG. 4, the cumulative count interval measurement portion 206 performs steps 6 to 9 described below instead of proceeding to step 4 described above.

When the current time is T3 shown in FIG. 4, since the TMS output device has changed from the OFF state to the ON state (YES at step 1), step 2 is performed. At step 2, the cumulative count interval measurement portion 206 calls up time T2 at which the answer was YES at the previous step 1 from the non-volatile memory 208 via the record processing portion 207 and subtracts time T2 from time T3 to calculate the period between these times. Since the TMS output device is in the ON state at time T3, the answer is YES at step 3, and thus the process proceeds to step 6. The TMS output device is maintained in the OFF state from time T2 to time T3. The cumulative count interval measurement portion 206 sets the period between these times (the period of T3-T2 calculated at step 2) as an "OFF duration".

At step 6, the operation of counting up of the cumulative number counter is performed (S6 in FIG. 3). The "cumulative number counter" used herein refers to the information on the cumulative number of changes of the TMS output device from the OFF state to the ON state, and is recorded in the non-volatile memory 208. The cumulative count interval measurement portion 206 counts up the cumulative number counter last recorded in the non-volatile memory 208 via the record processing portion 207 (adds 1 to the recorded cumulative number counter).

After performing step 6, the cumulative count interval measurement portion 206 performs step 7 for performing averaging processing on the calculated OFF duration of T3-T2 (S7 in FIG. 3). The averaging processing on the OFF duration is performed in the same manner as the ON duration described above.

After performing step 7, the cumulative count interval measurement portion 206 performs step 8 (S8 in FIG. 3) for calculating the "cycle time interval" shown in FIGS. 4 (T3-T1 in this example) by adding the calculated OFF duration of T3-T2 to the ON duration immediately before this OFF duration (the ON duration of T2-T1 in this example).

After performing step 8, the cumulative count interval measurement portion 206 performs step 9 for performing averaging processing on the calculated cycle time interval of T3-T1 (S9 in FIG. 3). The averaging processing on the cycle time interval is performed in the same manner as the ON duration and the like described above.

Then, at step 5 performed after performing step 8, the cumulative count interval measurement portion 206 updates the previous information recorded in the non-volatile memory 208 (S5 in FIG. 3). When the current time is T3 and the time at which the answer was YES at the previous step 1 is T2, the cumulative count interval measurement portion 206 updates the last information recorded in the non-volatile memory 208 from time T2 to time T3, and also updates the state of the TMS output device at time T2 (OFF state) to the state of the TMS output device at time T3 (ON state). The cumulative count interval measurement portion 206 also records, via the record processing portion 207, the OFF durations of T3-T2 and the cycle time intervals of T3-T1 before and after averaging processing in the non-volatile memory 208. After step 5, the current cumulative count interval measurement ends.

As a result of such cumulative count interval measurement, the non-volatile memory 208 records the ON duration, OFF duration, and cycle time interval before averaging processing and the ON duration, OFF duration, and cycle time interval after averaging processing, as well as the cumulative number counter, which is the cumulative number of ONs of the TMS output device. Outputting these information pieces to the information output portion 210 via the user interface processing portion 209 allows the user to know the cumulative number of ONs and the like of the TMS output device. This enables the user to determine whether the cumulative number of ONs of the TMS output device exceeds the allowable number of ONs and thus timely replace the TMS output device (for example, a relay or a valve). In this manner, a TMS output device that is frequently turned ON and therefore susceptible to failure can be replaced in advance, preventing unexpected stopping of the vacuum pump.

This example measures the cumulative number of ONs of the TMS output device, but the cumulative number of OFFs may be measured and output so that this information is used for timely replacement of the TMS output device.

Furthermore, although there may be some variations, the ON durations, OFF durations, and cycle time intervals of the TMS output device after averaging processing are likely to be in fixed ranges, as long as the operation of the apparatus subjected to exhaustion connected to the pump main body 100 is stable. That is, an abrupt change in the ON duration, OFF duration, cycle time interval, or the like after averaging processing allows the user to recognize a potential failure of the temperature adjustment means including the TMS output device (for example, a significant change in the cycle time interval of the valve connected to the water-cooled tube may indicate a failure of the valve itself, an abrupt change in the temperature of the cooling water, clogging of the water-cooled tube due to foreign matter, or other problems). That is, a potential future abnormality can be identified, even if the temperature measured by the temperature sensor arranged in the vicinity of the predetermined area of the pump main body 100 is within the predetermined range and thus shows that a heating or cooling abnormality is not actually present. Accordingly, a heating or cooling abnormality can be prevented by performing an appropriate inspection.

It should be noted that such prevention of heating or cooling abnormalities may be performed based on the ON duration, OFF duration, and cycle time interval before averaging processing. Also, the minimum values or the maximum values of the ON duration, OFF duration, and cycle time interval may be used.

Additionally, the technique of predicting a future failure from the ON duration and the like is not limited to the TMS output device, and is also applicable to other devices used in the pump main body 100. That is, the ON duration and the like of a device tend to be in a fixed range also when the pump main body 100 is continuously operated or when the pump main body 100 is periodically started and stopped. As such, performing an appropriate inspection when the duration exceeds the range may prevent a future failure of the pump main body 100.

Figure 5:
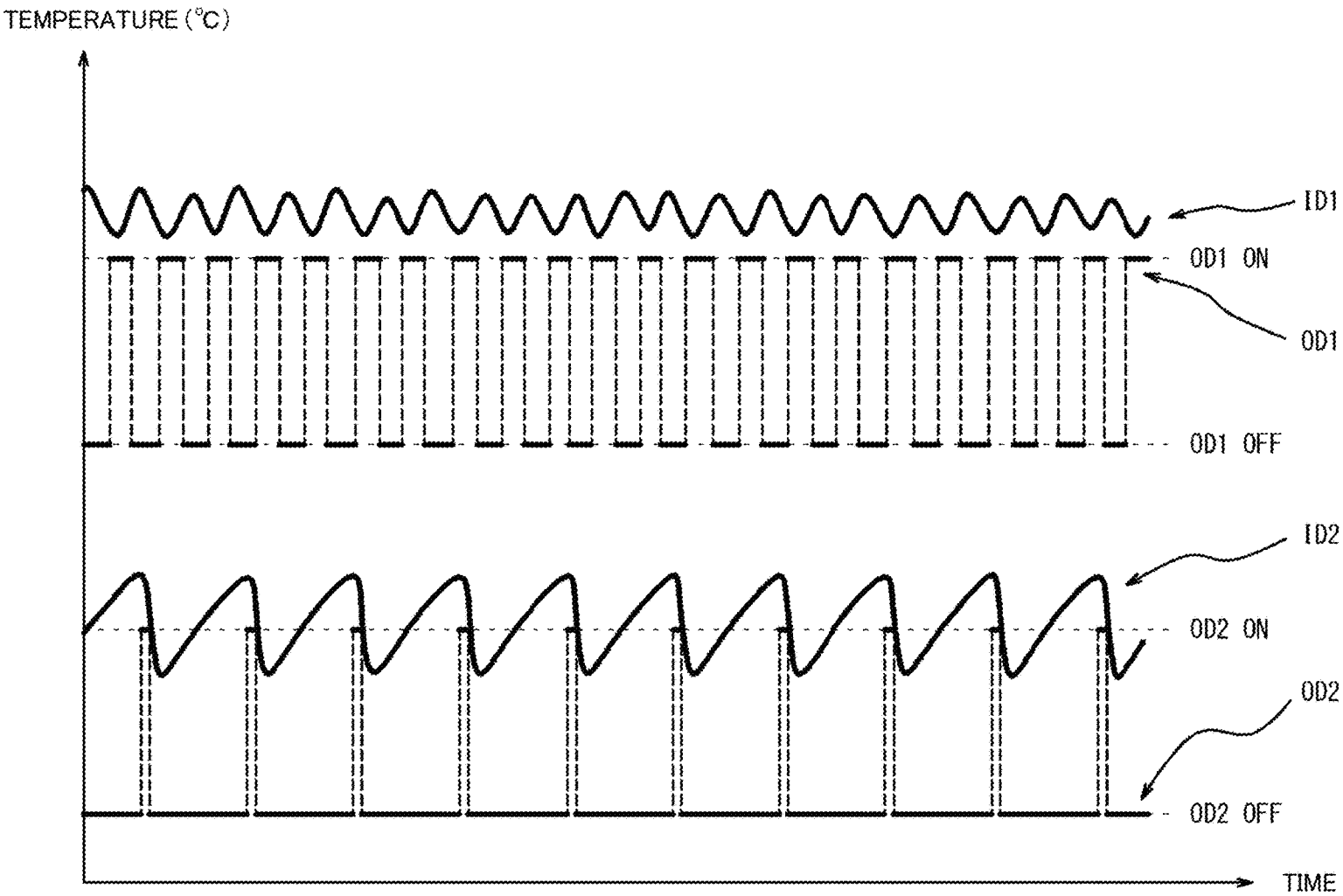
FIG. 5 is a diagram showing the relationship between the measured temperatures and the time for turning ON/OFF temperature adjustment means.

Referring to FIG. 5, specific examples of the ON duration, OFF duration, and cycle time interval of the TMS output device are now described. ID1 in FIG. 5 shows the relationship between time and the temperature obtained from a temperature sensor attached in the vicinity of an area heated by the TMS control. ID2 shows the relationship between time and the temperature obtained from a temperature sensor attached in the vicinity of an area cooled by the TMS control. OD1 shows the relationship between time and the ON/OFF signal output from the TMS output control portion 205 to the relay connected to the heater that performs heating by the TMS control. OD2 shows the relationship between time and the ON/OFF signal output from the TMS output control portion 205 to the valve connected to the cooling tube that performs cooling by the TMS control.

FIG. 6 shows the result of the above-mentioned cumulative count interval measurement performed on the TMS control shown in FIG. 5. The periods shown in FIG. 6 are periods after averaging processing.

As shown in FIGS. 5 and 6, the ON durations, OFF durations, and cycle time intervals of OD1 (relay) and OD2 (valve) are substantially within fixed ranges, although there are some variations. Accordingly, a probability of a heating or cooling abnormality of the predetermined areas of the pump main body 100 is determined to be low. When the ON duration of OD1 (relay) after averaging processing deviates from a predetermined range (a range of 1 minute 45 seconds±20 seconds in the example shown in FIGS. 5 and 6), the user can predict the possibility of a future failure. The user can thus prevent a heating or cooling abnormality by performing an appropriate inspection.

The controller 200 described above outputs the cumulative number counter, the ON duration, or the like of the TMS output device recorded in the non-volatile memory 208 to the information output portion 210 to inform the user. However, the controller 200 may be configured as shown in FIG. 7 and output a warning via the information output portion 210 when the cumulative number counter, the ON duration, or the like exceeds a predetermined value.

Figure 7:
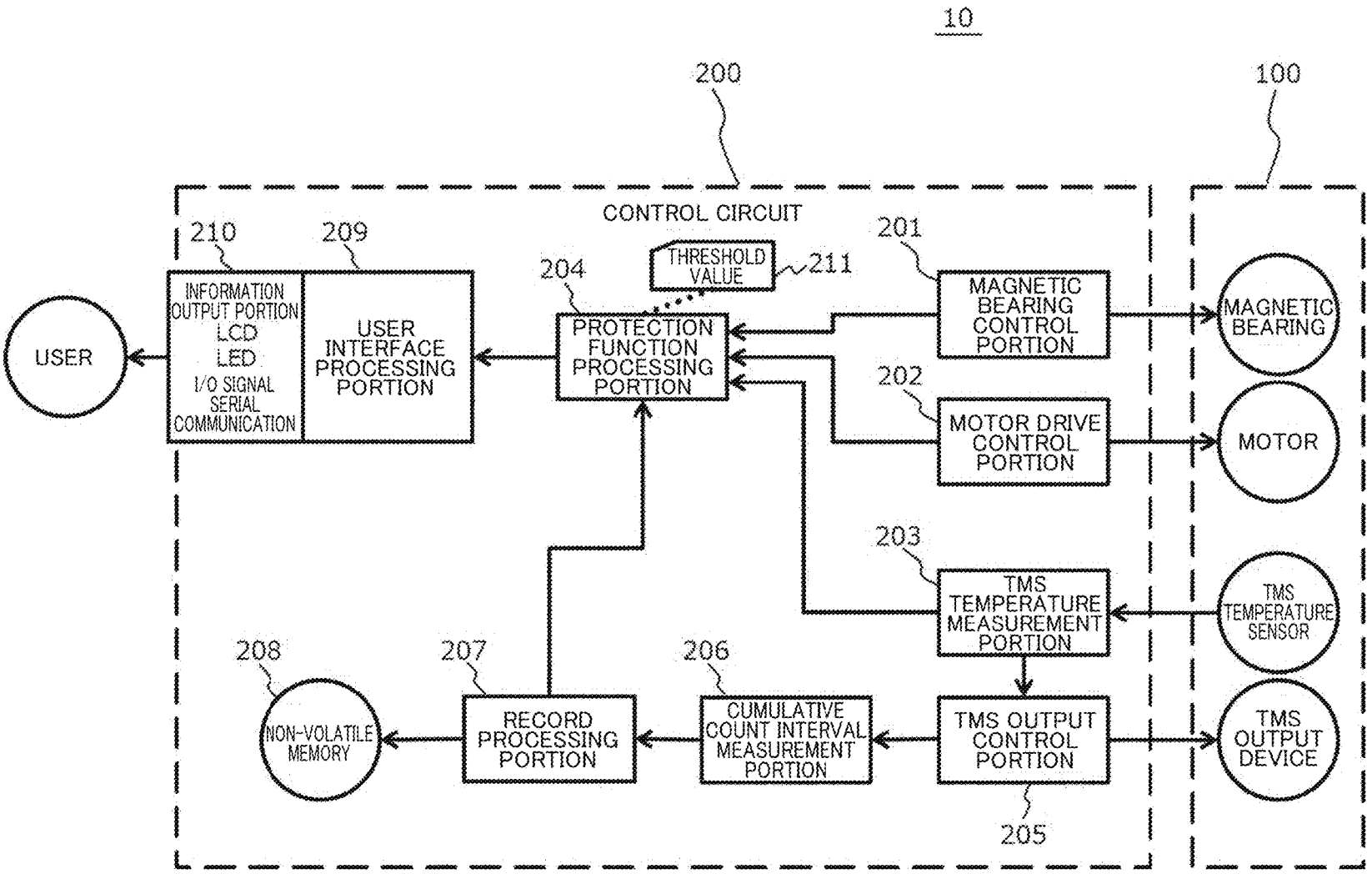
FIG. 7 is a diagram of a modification of the system configuration diagram of FIG. 2.
Figure 8:
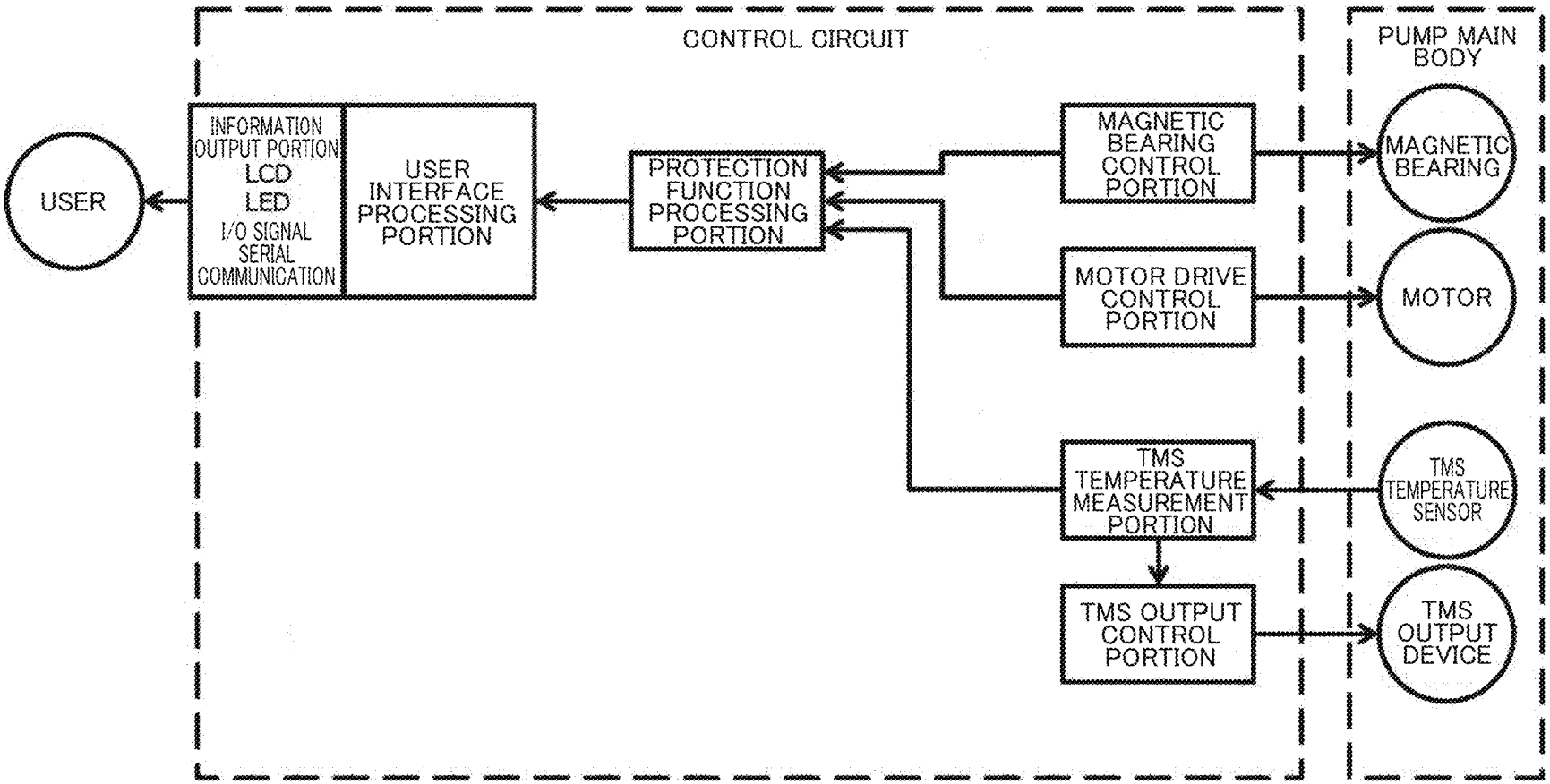
FIG. 8 is a system configuration diagram of a conventional vacuum pump (turbomolecular pump).

In the configuration shown in FIG. 7, the record processing portion 207 has a function of converting the measured value regarding ON/OFF of the TMS output device obtained from the cumulative count interval measurement portion 206 into data that can be processed by the protection function processing portion 204.

The protection function processing portion 204 has a function of recording various threshold values 211, compares the threshold values 211 with the measured value regarding ON/OFF of the TMS output device based on the data from the record processing portion 207, and outputs the comparison result data to the user interface processing portion 209.

For example, the allowable cumulative number of ONs of the TMS output device may be recorded as a threshold value 211. When the cumulative number of ONs of the TMS output device obtained from the record processing portion 207 exceeds the allowable cumulative number of ONs, a warning is issued by the information output portion 210 prompting the user to replace the TMS output device (for example, an LCD indicates that the TMS output device should be replaced). This reliably prompts the user to replace the TMS output device. Also, the allowable ON duration may be stored as a threshold value 211, for example. When the ON duration of the TMS output device obtained from the record processing portion 207 deviates from the threshold value 211, a warning may be issued via the information output portion 210 to prompt the user to inspect the temperature adjustment means. This prevents a heating or cooling abnormality of the pump main body 100.

The present disclosure is not limited to the examples described above. Various modifications and alternations are possible within the scope of the disclosure described in the claims, unless otherwise specified in the above description. Also, the effects of the examples described above are merely examples of the effects of the present disclosure. The effects of the present disclosure are not limited to the effects described above.

What is claimed is:

1. A vacuum pump for exhausting gas from an apparatus subjected to exhaustion, the vacuum pump comprising:

a temperature adjustment means for causing a predetermined area of the vacuum pump to have a predetermined temperature;

an output control means configured to operate the temperature adjustment means; and an information output means configured to output information regarding ON/OFF of the temperature adjustment means obtained from the output control means, wherein the information output means is configured to output information regarding a number of ONs or a number of OFFs of the temperature adjustment means as the information regarding ON/OFF of the temperature adjustment means.

* * * * *